US005382123A

United States Patent [19]

Dawson

[11] Patent Number: 5,382,123

[45] Date of Patent: Jan. 17, 1995

[54] DEVICE FOR SECURING STACKED LUMBER

[76] Inventor: William L. Dawson, P.O. Box 104, Caddo Mills, Tex. 75135

[21] Appl. No.: 981,101

[22] Filed: Nov. 24, 1992

[51] Int. Cl.[6] ..... B65D 63/00

[52] U.S. Cl. ..... 410/100; 414/786

[58] Field of Search ..... 410/31–42, 410/89, 96–100, 148, 152, 153, 155, 156; 53/399, 139.5, 139.6

[56] References Cited

U.S. PATENT DOCUMENTS

| | | | |
|---|---|---|---|
| 1,676,638 | 7/1928 | Eastham | 410/34 |
| 1,784,909 | 12/1930 | Romine | 410/40 |
| 1,793,059 | 2/1931 | Chambers | 410/36 |
| 1,849,692 | 3/1932 | Romine | 410/36 |
| 4,079,566 | 3/1978 | Stoecklin | 53/399 |
| 4,121,849 | 10/1978 | Christopher | 410/38 |
| 4,454,705 | 6/1984 | Benno | 53/349 |
| 4,566,831 | 1/1986 | Groth | 410/117 |
| 4,730,732 | 3/1988 | Wagonseller | 410/42 |
| 4,747,252 | 5/1988 | Kopke | 53/399 |

*Primary Examiner*—Michael S. Huppert
*Assistant Examiner*—Gregory A. Morse
*Attorney, Agent, or Firm*—Richards, Medlock & Andrews

[57] ABSTRACT

A device (10) is disclosed for securing a stack (18) of lumber (20) or other elements by a strap (28) under tension. The device (10) has a first surface (14) which has a convex shape when undeformed. The first surface is placed in contact with the surface of the stack and the strap laid over the second surface (16) and tensioned. The tension in the strap causes the device (10) to deform to reduce the convexity of the first surface so that the first surface comes into uniform engagement with the individual elements defining the upper surface of the stack.

5 Claims, 2 Drawing Sheets

FIG. 3
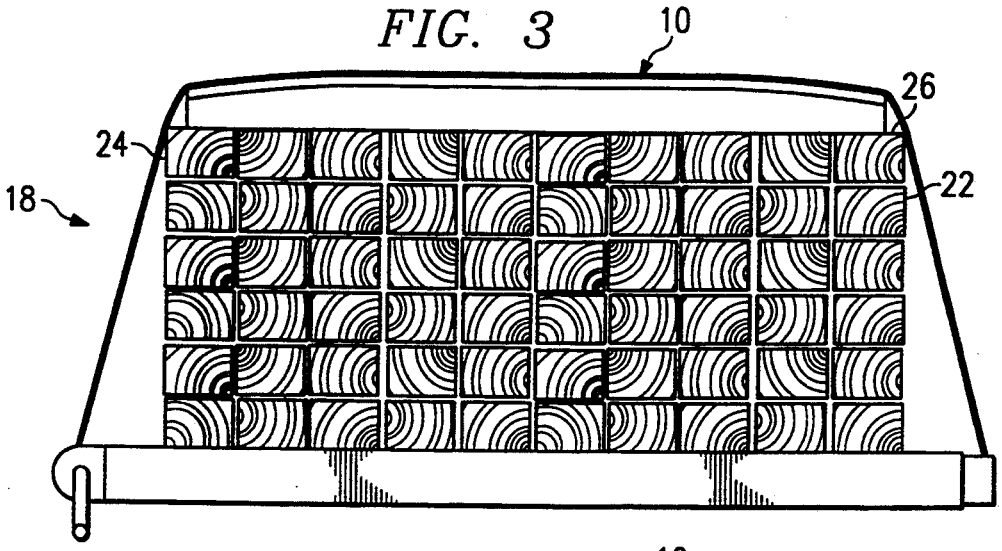
FIG. 4
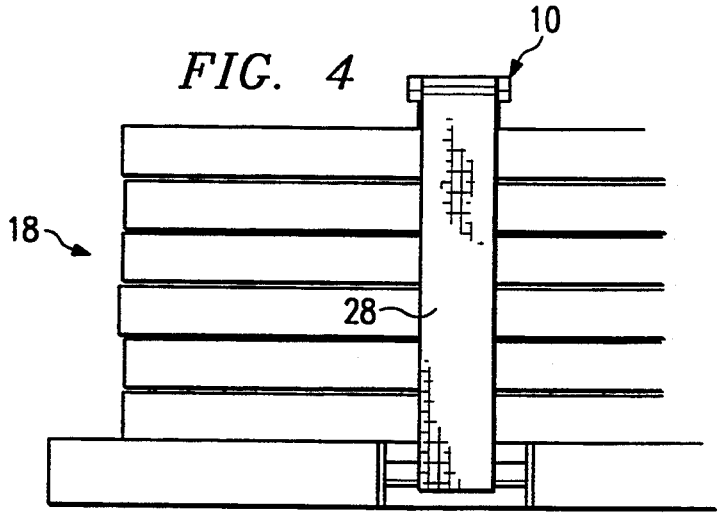
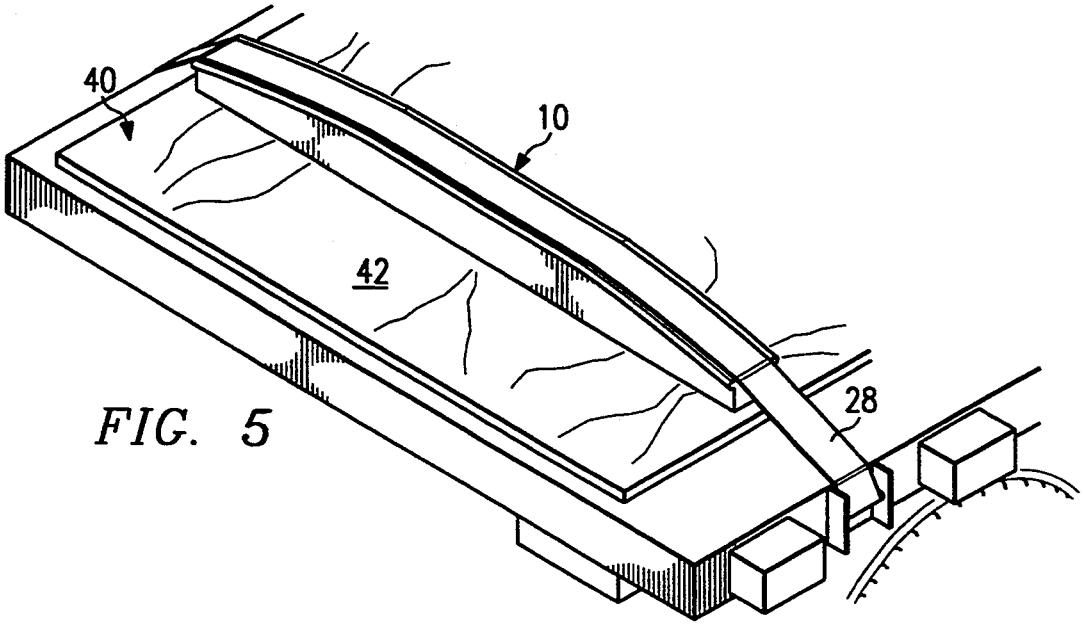
FIG. 5

DEVICE FOR SECURING STACKED LUMBER

TECHNICAL FIELD OF THE INVENTION

This invention relates to the shipment of stacked lumber, typically by truck or railroad.

BACKGROUND OF THE INVENTION

Lumber is commonly carried by truck or rail car by stacking the lumber into a stack or bundle and securing the stack to the vehicle by straps under tension.

In a typical configuration, this stack is assembled on top of the bed of the trailer to form a rectangular bundle with vertical sides and a horizontal top surface. The straps are passed over the sides and top surface and tensioned at both ends to the bed to secure the bundle in place.

While the straps are generally effective, particularly in preventing horizontal shifting of the sides of the bundle and the lumber at the top edge of the upper surface, frequently the lumber near the center of the top surface is not tightly secured. This can lead to shifting of these pieces of lumber. Occasionally, the lumber pieces can actually fall from the bundle onto the highway or track or forward into the cab of the truck. Clearly, the shifting of lumber can have serious consequences.

A need therefore exists for a more reliable technique to secure the lumber in such a bundle to avoid shifting of the lumber, particularly of the pieces in the top of the bundle.

SUMMARY OF THE INVENTION

In accordance with one aspect of the present invention, a flexible member is provided for use in securing a load of discrete elements stacked to define a relatively flat surface with a strap. The flexible member has a first surface and a second surface. The first surface has a convex shape when the flexible member is not exposed to external forces. The first surface is laid in contact with the flat surface of the elements and the strap is extended over the second surface of the flexible member with the strap tensioned. The tensioning of the strap will bend the flexible member to reduce the convexity of the flexible member and cause the first surface to uniformly engage the elements defining the flat surface. Thus, these elements will be held tightly by the tension exerted by the strap.

In accordance with another aspect of the present invention, the flexible member is made out of plastic. The second surface of the flexible member can also have a convex shape.

In accordance with another aspect of the present invention, a method of securing a load of discrete elements stacked to define a relatively flat surface with a strap includes the steps of placing a flexible member having a first surface and a second surface on the relatively flat surface. The first surface of the flexible member is in contact with the relatively flat surface. The first surface has a convex shape when the flexible member is not exposed to external forces. The method further includes the step of tensioning the strap over the second surface of the flexible member and deforming the flexible member so that the convexity of the first surface is decreased, causing the flexible member to uniformly engage the elements defining the flat surface.

BRIEF DESCRIPTION OF THE DRAWINGS

For a more complete understanding of the present invention and the advantages thereof, reference is now made to the following description taken in conjunction with the accompanying drawings in which:

FIG. 3 is a end view of the stack of lumber showing the device positioned;

FIG. 4 is a side view of the device with a strap across the device to deform the device against the flat surface of the stack of lumber;

FIG. 5 illustrates the use of a device to secure a thin load without damage to the surface of the load.

DETAILED DESCRIPTION

Figure 1:
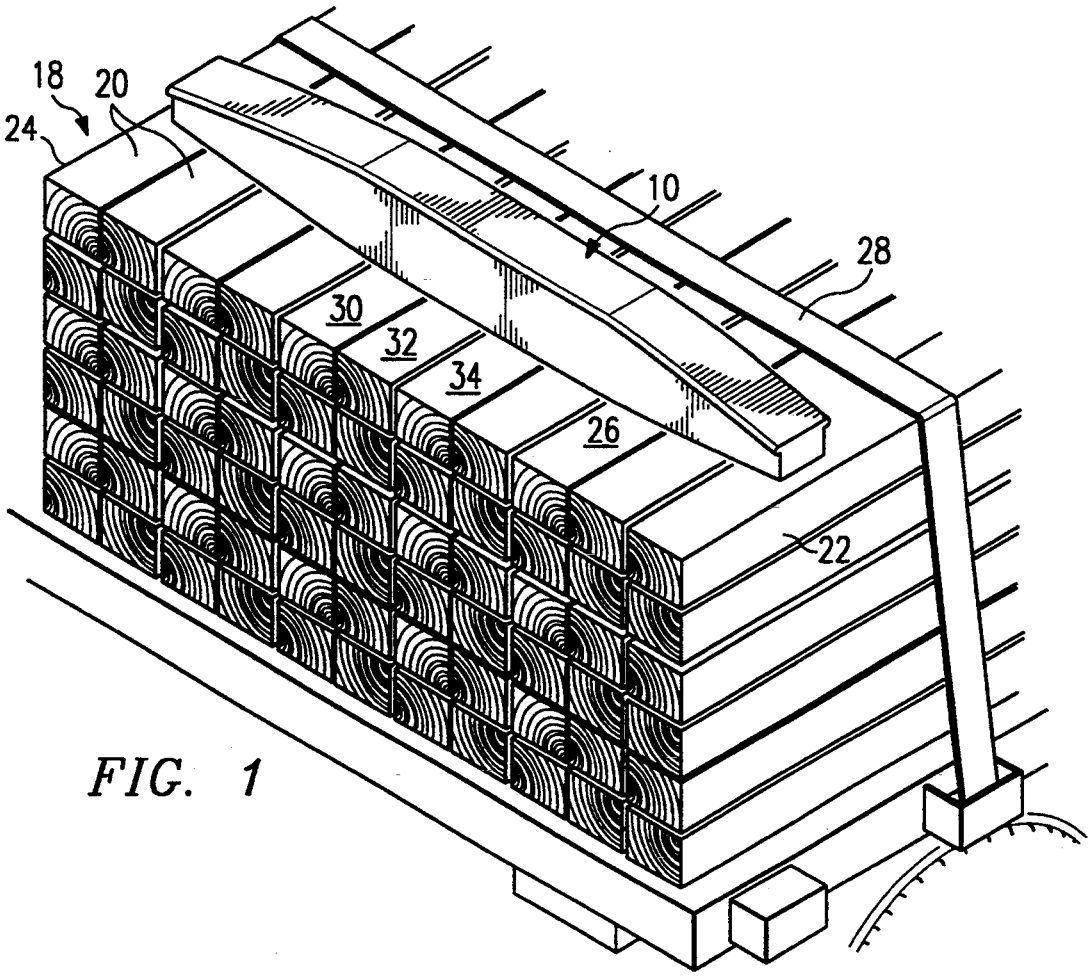
FIG. 1 is a perspective view of a device forming a first embodiment of the present invention positioned on a stack of lumber.
Figure 2:
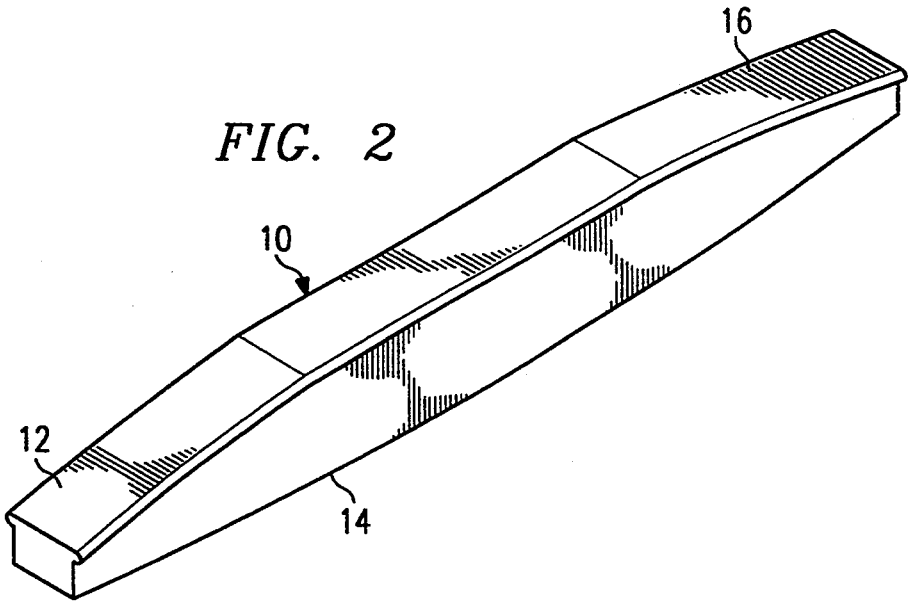
FIG. 2 is a perspective view of the device shown separate from the stack of lumber.

With reference now the drawings, wherein like reference numerals designate like or corresponding parts throughout the several views, a device 10 is illustrated which forms a first embodiment of the present invention. The device 10 can be seen to comprise a unitary flexible member 12 with a first surface 14 having a convex shape when the device is not exposed to external forces and a second surface 16 which has a permanent convex shape.

The device 10 is particularly useful in securing a stack 18 of individual pieces of lumber 20 for transport by truck or rail car. As illustrated in FIGS. 1–4, a common configuration of a stack 18 is to place the lumber 20 on top of the bed of the truck trailer or railroad car and construct a rectangular stack with vertical side walls 22 and 24 and a horizontal upper flat surface 26.

Commonly, a series of straps 28 are tensioned about the stack of lumber as shown in FIG. 1. The straps generally prevent movement of the lumber 20 on the sides of the stack and at the edges of the upper surface. However, lumber near the center of the upper surface, such as lumber 30, 32 and 34 are often not held tightly, if at all, within the stack by the straps. If the lumber is placed in the fore to aft configuration of FIGS. 1 and 3, the loose lumber will tend to slide either forward off the bundle or rearward off the bundle as the truck decelerates or accelerates on the highway. It is not uncommon for pieces of lumber to actually fall off a bundle behind the truck and onto the highway or to move forward and strike the cab of the truck. If the lumber is stacked from side to side, the individual lumber can fall to the left or right side of the truck going down the highway.

The device 10 operates to tightly secure the lumber forming the upper surface 26 of a stack 18 by deforming itself into contact with a majority of the pieces of lumber forming the upper surface. For example, if the device 10 were laid on the upper surface 26 and not exposed to external forces, the convex shape of the first surface would cause the first surface to only come into contact with lumber 32, with the convex side being spaced further from the lumber near the ends of the device. However, if a strap 28 is stretched over the second surface 16 of the device, and the strap tensioned in the typical fashion, the device 10 will deform under the tension of the strap and the convexity of the first surface will decrease so that the first surface also comes into contact with lumber 30 and 34.

Continued deformation will cause the first surface to engage the pieces of lumber immediately outboard of lumber 30 and 34 and a continued increase in tension will continue to cause the first surface to come into engagement with more outward lumber as the strap is further tensioned while maintaining continuous engagement with lumber 32, 30 and 34. When the strap is properly tensioned, the device 10 secures the lumber across the entire upper surface of the stack so that the lumber will have no tendency to move or shift during transportation.

The device 10 will preferably be formed of a hard, flexible plastic, rubber or aluminum. It would be a good use of recycled plastic as the external appearance of the device will be of little concern to the personnel using the device in a functional way. If made of rubber, it would be a good way to recycle old tires. The device could also be formed of aluminum with an outer layer or coating of rubber or plastic to resist damage to both the aluminum and the cargo. It would be anticipated that the length of the device would be about 42 inches and a height of about 3 inches separating the first and second surfaces at their maximum separation.

With reference to FIG. 5, the device 10 can be seen to have applications to transportation of a stationary thin load, represented by a sheet of plywood 40. Again, the plywood 40 is placed atop the bed of a railroad or truck trailer. In the past, tensioning the plywood with a strap 28 alone would often provide an unreliable securing of the plywood as the strap will act on the plywood only at the outer edges of the plywood. By using the device 10, the tension in the strap can be transformed into a relatively uniform application of force along the first surface 14 of the device and the upper surface 42 of the piece of plywood. This allows the piece of plywood to be much better secured on the vehicle. Further, as the first surface is smooth, the device will leave no scratch or deformation on the surface of the plywood.

While the device 10 is utilized preferably to secure a bundle of lumber, the advantages can be readily applied to secure any number of individual elements assembled in a stack or bundle. For example, the device can be laid along a surface of a bundle of drill pipe, sewer pipe, containers, barrels, and the like.

While one embodiment of the present invention has been illustrated in the accompanying drawings, and described in the foregoing detailed description, it will be understood that the invention is not limited to the embodiment disclosed, but is capable of numerous rearrangements, modifications and substitutions of parts and elements without departing from the spirit of the invention.

I claim:

1. A method of securing lumber in a stack, the stack having a first substantially flat surface comprising a plurality of individual elements, comprising the steps of:

placing a flexible member having a convex surface such that it contacts a first number of said elements;

placing a strap over the flexible member relative to the stack;

tensioning said strap, whereby said tensioning reduces the convexity of the convex surface and causes said surface to contact a second number of said elements, said second number of elements being greater than said first number of elements.

2. The method of claim 1 further comprising the step of forming the flexible member of a flexible rubber.

3. The method of claim 1 further comprising the step of forming the flexible member of aluminum.

4. The method of claim 1 further comprising the step of coating the flexible member with a material selected from the group consisting of rubber and plastic.

5. The method of claim 1 further comprising the step of forming the flexible member with a length of about 42 inches and a height of about 3 inches.

* * * * *